US005911093A

United States Patent [19]

Ohsawa

[11] Patent Number: 5,911,093

[45] Date of Patent: Jun. 8, 1999

[54] MULTI-COLOR IMAGE FORMING APPARATUS CAPABLE OF PREVENTING CONTAMINATION OF RE-CHARGER

[75] Inventor: Keishi Ohsawa, Yokohama, Japan

[73] Assignee: Canon Kabushiki Kaisha, Tokyo, Japan

[21] Appl. No.: 08/995,197

[22] Filed: Dec. 19, 1997

[30] Foreign Application Priority Data

Dec. 24, 1996 [JP] Japan ..... 8-355648

[51] Int. Cl.[6] ..... G03G 15/02; G03G 15/01

[52] U.S. Cl. ..... 399/50; 399/98; 399/171

[58] Field of Search ..... 399/40, 50, 98, 399/99, 100, 168, 170, 171, 223; 250/324, 325, 326; 361/214, 225

[56] References Cited

U.S. PATENT DOCUMENTS

| | | | |
|---|---|---|---|
| 4,349,268 | 9/1982 | Hirata | 399/135 |
| 4,416,533 | 11/1983 | Tokunaga et al. | 347/118 |
| 4,460,961 | 7/1984 | Op de Beek | 378/55 |
| 4,572,651 | 2/1986 | Komatsu et al. | 399/231 |
| 5,181,072 | 1/1993 | Furuya et al. | 399/171 |
| 5,359,393 | 10/1994 | Folkins | 399/50 |
| 5,365,325 | 11/1994 | Kumasaka et al. | 399/40 |
| 5,438,401 | 8/1995 | Murayama et al. | 399/171 X |
| 5,666,604 | 9/1997 | Nakagami et al. | 399/171 |
| 5,666,605 | 9/1997 | Tokimatsu et al. | 250/324 X |

FOREIGN PATENT DOCUMENTS

| | | |
|---|---|---|
| 56-012650 | 2/1981 | Japan . |
| 56-144452 | 11/1981 | Japan . |

*Primary Examiner*—Shuk Lee
*Assistant Examiner*—Sophia S. Chen
*Attorney, Agent, or Firm*—Fitzpatrick, Cella, Harper & Scinto

[57] ABSTRACT

An image forming apparatus including a photosensitive member, a first developer for developing an electrostatic latent image on the photosensitive member, a charger adapted to charge the photosensitive member bearing a first developed image formed by the first developer and having a discharge electrode member and a shield member surrounding the discharge electrode member, an exposure device for image-exposing the photosensitive member charged by the charger, a second developer for developing an electrostatic latent image formed by exposure of the exposure device, and a voltage apply device for applying voltage having the same polarity as that of the first developed image to the shield member.

5 Claims, 6 Drawing Sheets

MULTI-COLOR IMAGE FORMING APPARATUS CAPABLE OF PREVENTING CONTAMINATION OF RE-CHARGER

BACKGROUND OF THE INVENTION

1. Field of the Invention

The present invention relates to an image forming apparatus such as a printer, a copying machine and the like, and more particularly, it relates to a multi-color image forming apparatus capable of forming a multi-color image 2. Related Background Art Recently, a multi-color image obtained by composing different color visualized images or different informations on a sheet has been proposed, and, to this end, multi-color image forming apparatuses having a plurality of developing devices have been put on the market.

Among these multi-color image forming apparatuses, there has widely been proposed a multi-color image forming apparatus in which multi-color development is effected by using two or more developing devices during one revolution of an image bearing member and the developed different color images are correctively transferred onto a transfer material (for example, sheet). For example, U.S. Pat. Nos. 4,572,651 and 4,416,533 disclose a technique in which development is effected by two developing devices while keeping electric fields thereof constant by using DC bias. However, these patents mainly discuss a method for forming a latent image and do not teach problems caused in the development On the other hand, U.S. Pat. No. 4,349,268 and the Japanese Patent Application Laid-Open No. 56-144452 (1981) disclose a technique in which a first color visualized image (toner image) is prevented from being distorted by sliding contact with second color developer by using a non-contact developing method for applying AC developing bias to the second color developer, and the Japanese Patent Application Laid-Open No. 56-12650 (1981) discloses a technique in which a first color visualized image is prevented from being distorted by sliding contact with second color developer by using a non-contact developing method for applying DC developing bias to the second color developer. Incidentally, the above-mentioned Japanese Patent Application Laid-Open No. 56-144452 does not describe potential of the first color toner image.

In this way, conventionally, in the multi-color image formation, although it is well-known to effect next color development without distorting the previously formed toner image, in order to achieve the same purpose, it is also known to increase potential level of a latent image for a toner image to be firstly developed. For example, U.S. Pat. No. 4,460,961 discloses a technique in which, after a first color toner image is formed, by charging an entire surface of an image bearing member with polarity same as that of the toner to bring potential of a latent image for the first color toner image (surface potential of a portion of the image bearing member on which the first color toner image is formed) to be substantially equal to potential of a non-developed portion (non-image portion), second color development can be effected without distorting the first color toner image. This technique is called as "negative-negative re-charging system" in a one-pass multi-color image forming apparatus and has recently been investigated widely.

However, the above-mentioned conventional negative-negative re-charging system arises the following problems.

After the first color toner image is formed, when the image bearing member is charged with the same polarity as that of the toner by means of a second color charger (re-charger), the first color toner on the image bearing member is scattered toward and adhered to a shield and a grip portion of the re-charger, thereby smudging the latter. The toner contamination on the shield and the grip portion is gradually accumulated as the copying operation is repeated, with the result that a corona wire of the re-charger is contaminated by toner, thereby causing uneven charging of the image bearing member due to poor re-charging of the re-charger.

Consequently, the potential of the latent image form the first color toner image does not become substantially the same as the potential of the non-image portion, with the result that the first color toner image is distorted during the second color development or the toner is adhered to other portions rather than a second color latent image. Further, since the first color developer enters into the second color and other developing devices, the first color developer is gradually used in the second color and other developing devices during the image formation, thereby making an image obscure.

SUMMARY OF THE INVENTION

An object of the present invention is to provide a multi-color image forming apparatus in which contamination of a re-charger can be prevented when a toner image is passed through the re-charger.

Another object of the present invention is to provide a multi-color image forming apparatus which can prevent uneven charging of a re-charger.

A further object of the present invention is to provide a multi-color image forming apparatus which comprises a photosensitive member, a first developing means for developing an electrostatic latent image on the photosensitive member, a charge means adapted to charge the photosensitive member bearing a first developed image formed by the first developing means and having a discharge electrode member and a shield member surrounding the discharge electrode member, an exposure means for image-exposing the photosensitive member charged by the charge means, a second developing means for developing an electrostatic latent image formed by exposure of the exposure means, and a voltage apply means for applying voltage having the same polarity as that of the first developed image to the shield member.

The other objects of the present invention will be apparent from the following detailed explanation of the invention.

DETAILED DESCRIPTION OF PREFERRED EMBODIMENTS

The present invention will now be explained in connection with embodiments thereof with reference to the accompanying drawings.

First Embodiment

Figure 1:
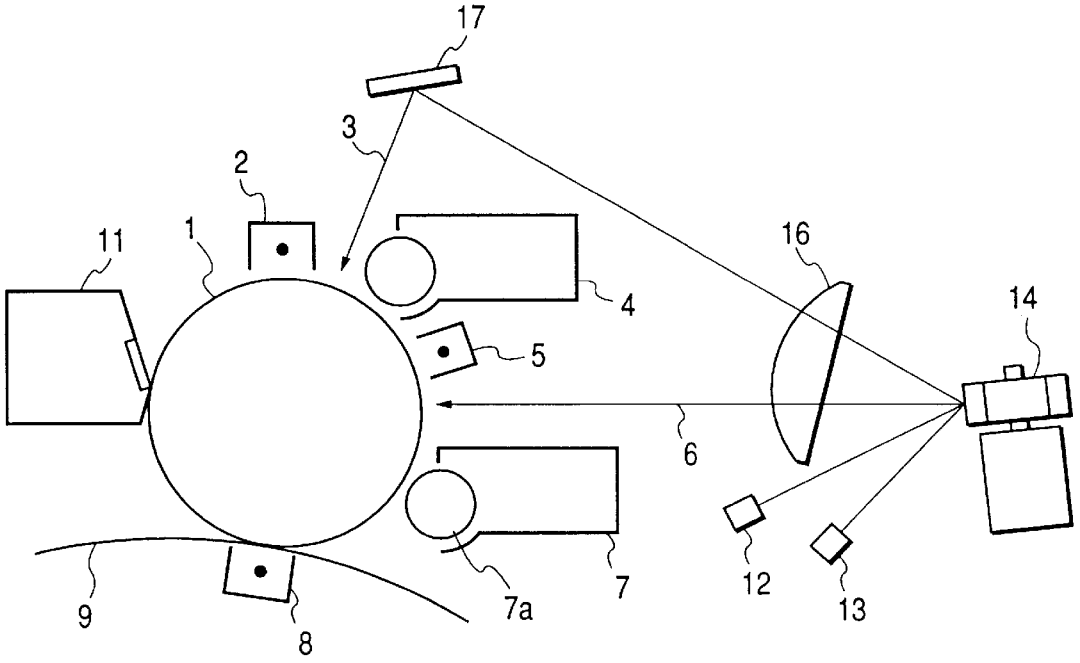
FIG. 1 is a schematic constructural view of an image forming apparatus according to a preferred embodiment of the present invention.

FIG. 1 is a schematic constructural view of an image forming apparatus according to a first embodiment of the present invention. An electrophotographic apparatus shown in FIG. 1 includes a photosensitive drum (image bearing member) 1 on which an electrostatic latent image is formed, and a surface of the photosensitive drum 1 is charged by a first charger 2 with negative potential of about −600 V. Then, a first laser beam 3 (from an image exposure system) modulated in response to a first color image signal is illuminated on the photosensitive drum 1, with the result that surface potential of the illuminated portion becomes about −100 V, thereby forming a first color latent image. The first latent image is inversion-developed by a first developing device 4 with two-component developer including negatively charged red toner and magnetic ferrite particles (carrier), thereby visualizing the latent image as a first red color toner image.

The photosensitive drum 1 on which the first toner image was formed is negatively charged again by a second charger (re-charger) 5 to increase the potential of the first toner image from −100 V to −700 V. Then, a second laser beam 6 (from the image exposure system) modulated in response to a second color image signal is illuminated on the photosensitive drum 1, with the result that surface potential of the illuminated portion becomes about −100 V, thereby forming a second color latent image. The second latent image is inversion-developed by a second developing device 7 with one-component black developer (black toner) in a jumping developing manner, thereby visualizing the latent image as a second black color toner image. In the development, bias obtained by overlapping AC voltage with DC voltage is applied to a developing sleeve 7*a* of the second developing device 7.

The first and second toner images formed on the photosensitive drum 1 in this way are collectively transferred, by a transfer charger 8, onto a transfer material 9 supplied to a transfer portion where the transfer charger 8 is opposed to the photosensitive drum 1. The transfer material 9 to which the toner images were transferred is sent to a fixing device (not shown), where the toner images are fixed to the transfer material. Residual toner remaining on the photosensitive drum 1 is removed by a cleaning device 11, thereby preparing for next image formation The image exposure system includes semi-conductor lasers 12, 13 for emitting the first and second laser beams 3, 6 modulated by the first and second color signals, a rotating polygon mirror 14 for deflecting the laser beams 3, 6, and a focusing lens 16 for focusing the deflected laser beams 3, 6. The first laser beam 3 passed through the focusing lens 16 is reflected by a reflection mirror 17 to be incident on the surface of the photosensitive drum 1 and the second laser beam 6 passed through the focusing lens 16 is directly incident on the surface of the photosensitive drum 1, thereby luster-scanning the surface of the photosensitive drum, thereby forming the first and second color latent images, respectively.

Figure 2A:
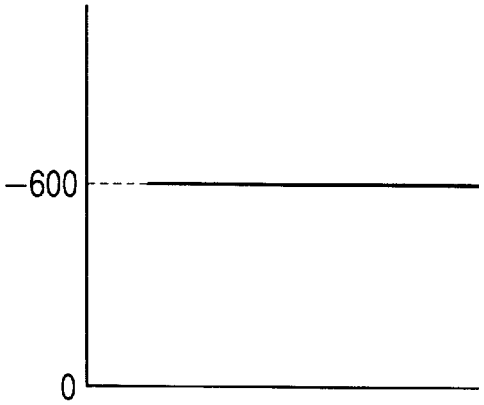
FIGS. 2A, 2B, 2C, 2D, 2E and 2F are schematic views showing change in surface potential of a photosensitive member of the image forming apparatus of FIG. 1 in a negative-negative re-charging system.
Figure 2D:
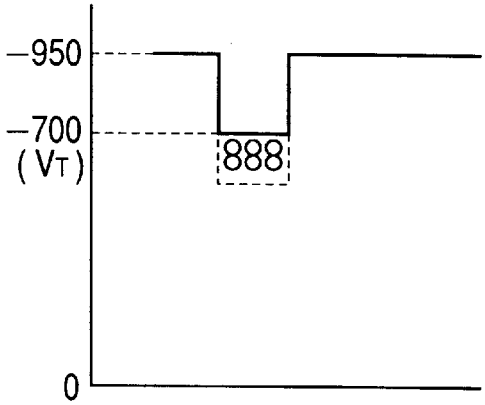
Figure 2B:
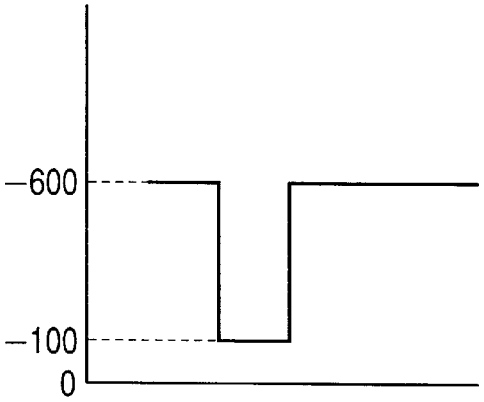
Figure 2E:
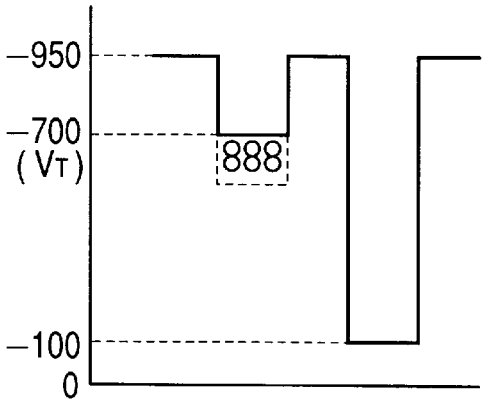
Figure 2C:
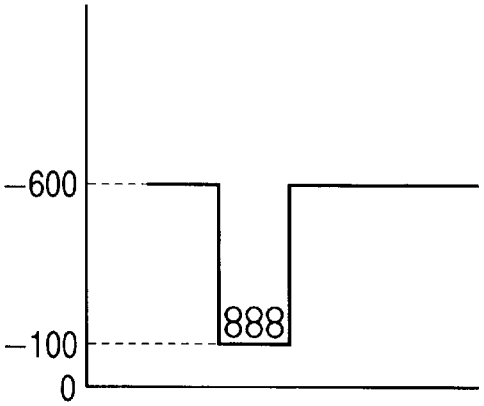
Figure 2F:
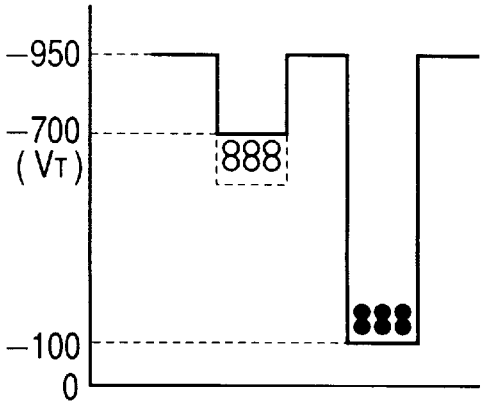

FIGS. 2A to 2F show change in surface potential of the photosensitive drum 1 during the image formation. The surface of the photosensitive drum 1 is uniformly charged by the first charger 2 to −600 V (FIG. 2A), and the potential of the illuminated portion (on the photosensitive drum) is reduced to −100 V by illumination of the first laser beam 3, thereby forming the first latent image having potential of −100 V (FIG. 2B). After the first latent image is developed by the developing device 4 to form the first toner image is developed by the developing device 4 to form the first toner image (FIG. 2C), the surface of the photosensitive drum 1 is negatively charged by the re-charger 5 with the same polarity as that of the toner, with the result that the potential of the first toner image becomes −700 V (FIG. 2D). Then, the potential of the illuminated portion (on the photosensitive drum) is reduced to −100 V by illumination of the second laser beam 6, thereby forming the second latent image having potential of −100 V (FIG. 2E). Then, the second latent image is developed by the developing device 7 to form the second toner image (FIG. 2F).

Figure 3:
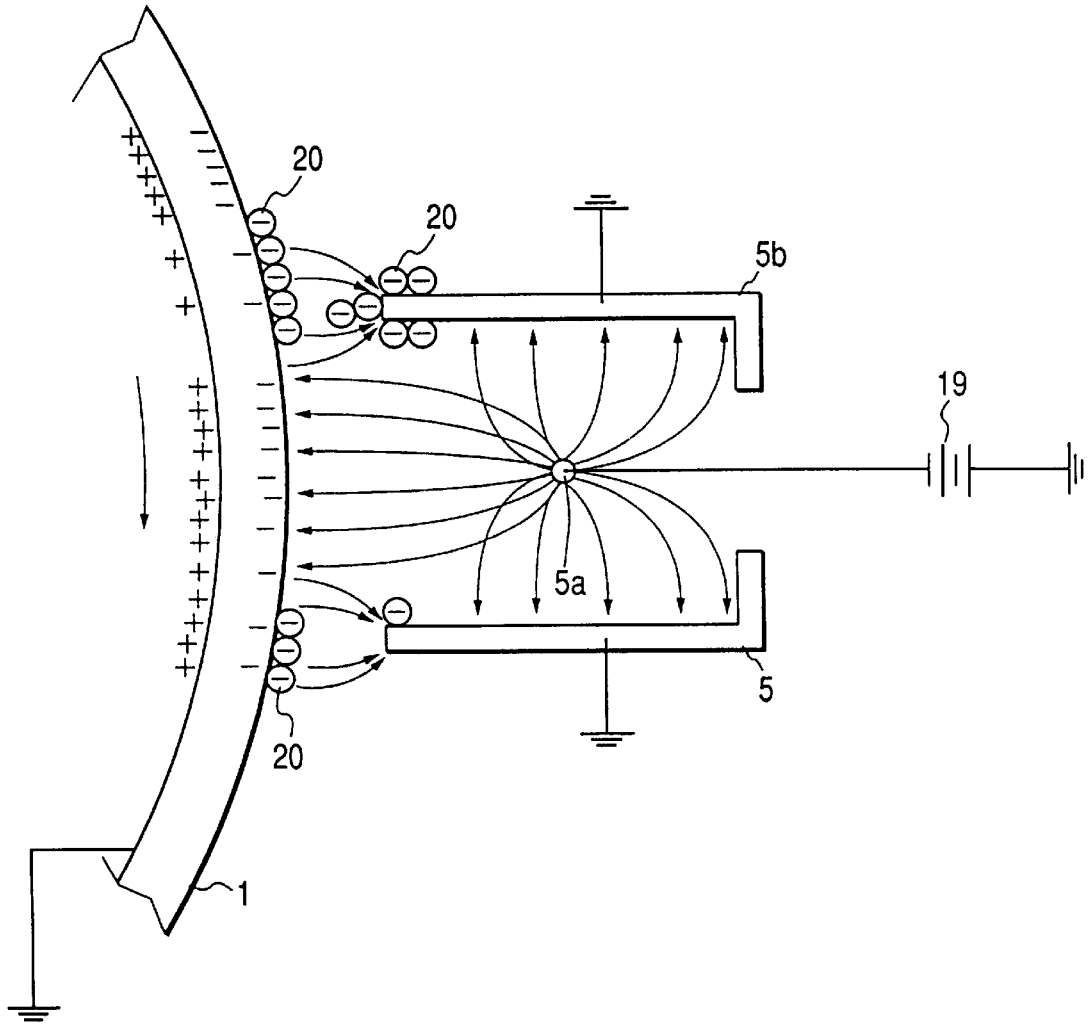
FIG. 3 is an explanatory view showing a mechanism of toner contamination on a re-charger of the image forming apparatus.

Now, a mechanism for generating toner contamination of the re-charger 5 will be explained with reference to FIG. 3. FIG. 3 is a schematic view showing charge distribution generated on a photosensitive layer and a substrate of the photosensitive drum 1 after the first latent image on the photosensitive drum 1 is developed. The first toner image is formed by selectively adhering negative toner particles 20 to the first latent image portion (less charged portion) of the photosensitive drum 1 due to the inversion-development of the first developing device 4. Since the inversion-development is effected, the negative toner particles 20 on the surface of the photosensitive drum 1 are adhered to the surface of the photosensitive drum 1 with weak electrostatic force (such as Coulomb force). In this condition, when the photosensitive drum 1 is rotated in a direction shown by the arrow in FIG. 3, the toner particles 20 reach the charging area of the re-charger 5.

High voltage is applied from a high voltage source 19 to the re-charger so that constant current of about −700 $\mu$A flows through a corona wire 5*a,* with the result that the surface of the photosensitive drum 1 is corona-charged. In this case, an electric field generated between the re-charger 5 and the photosensitive drum 1 starts from the corona wire 5*a* and is gradually widened within a shield 5*b* to reach the surface of the photosensitive drum 1. On the other hand, since the shield 5*b* of the re-charger 5 is grounded, a reverse electric field extending from the first latent image portion on the photosensitive drum 1 to a portion of the shield 5*b* near the photosensitive drum 1 is generated. Due to the reverse electric field, the negative toner particles 20 adhered to the surface of the photosensitive drum 1 are subjected to an electric field force for transferring the negative toner particles 20 from the photosensitive drum 1 to the shield 5*b*.

However, when the photosensitive drum is corona-charged by the re-charger 5, positive charges are generated on the substrate of the photosensitive drum 1. Due to such positive charges, the negative toner particles 20 on the surface of the photosensitive drum 1 are subjected to the Coulomb force to increase the adhering force between the toner particles 20 and the photosensitive drum 1, thereby overcoming against the reverse electric field force. Accordingly, all of the negative toner particles 20 on the surface of the photosensitive drum 1 are not flying toward the shield 5*b,* but, a large amount of toner particles 20 are remained on the surface of the photosensitive drum 1 and only toner particles 20 adhered to the photosensitive drum 1 with very weak electrostatic force are flying toward and adhered to the shield 5*b,* thereby generating toner contamination of the shield. The toner contamination of the portion of the shield 5*b* neat the photosensitive drum 1 is relatively reduced at an upstream side of the photosensitive drum 1 in the rotational direction thereof.

If the toner contamination is generated on the shield 5*b* of the re-charger 5 in this way, the toner contamination is accumulated as the copying operation is repeated, with the result that the toner contamination is transmitted to the wire 5*a* of the re-charger 5. Consequently, as mentioned above, the poor image is generated due to uneven charging of the photosensitive drum 1.

Figure 4:
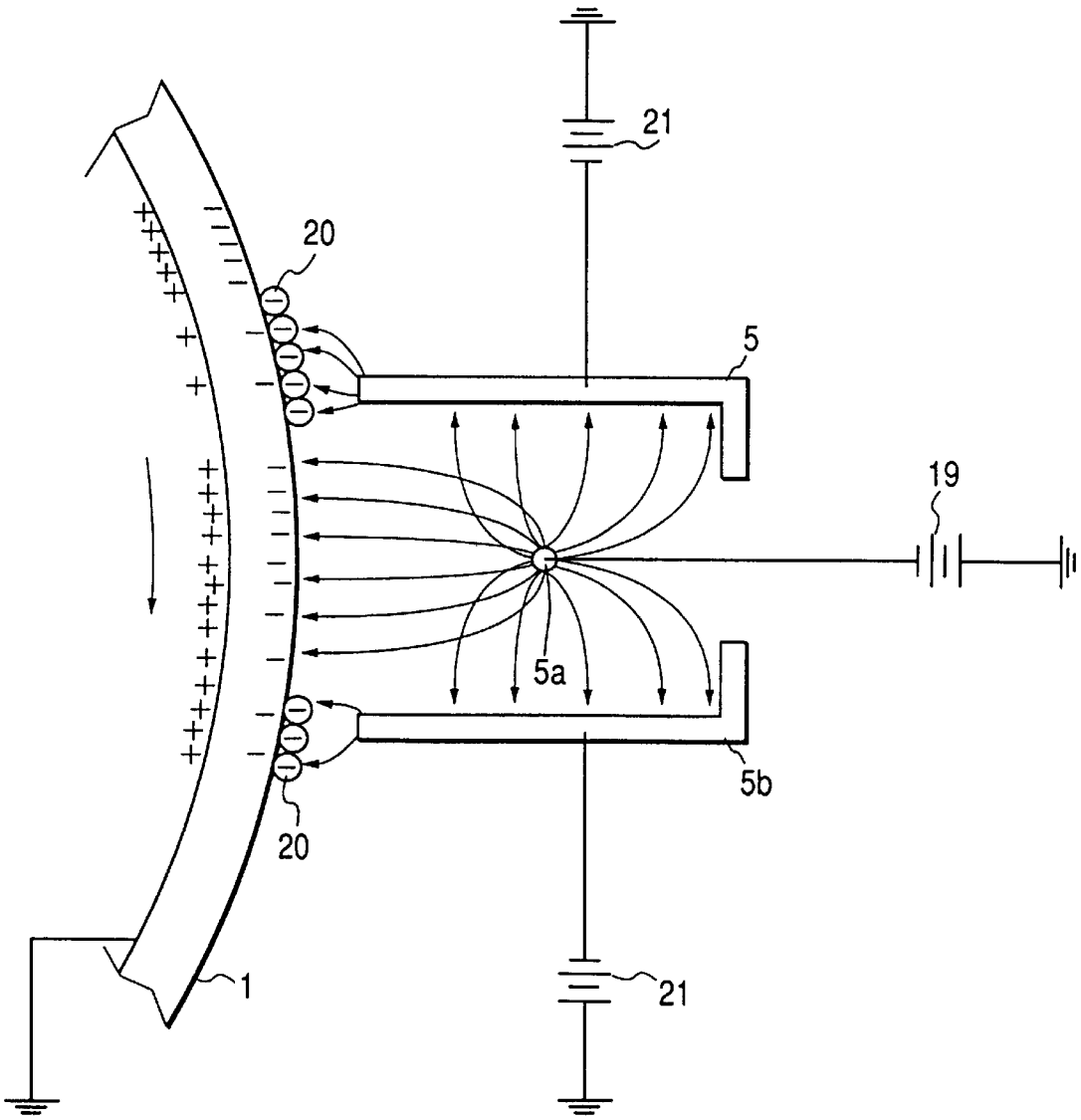
FIG. 4 is an explanatory view showing prevention of the toner contamination on the re-charger of the image forming apparatus of FIG. 1.

To avoid such inconvenience, in the illustrated embodiment, as shown in FIG. 4, the shield 5*b* of the re-charger 5 is connected to an external electric power source 21 so that voltage of −850 V is applied to the shield 5*b*.

As shown in FIG. 2D, after the first toner image is formed, the surface potential of the re-charged photosensitive drum 1 becomes minimum at the first toner image portion (toner layer potential ($V_T$)=about−700 V) and becomes maximum at the first laser beam non-illumination portion, i.e., non-image portion (potential=−950 V) (FIG. 2C). In this condition, when the voltage of −850 V is applied to the shield 5*b* of the re-charger 5 from the external electric power source 21, at the portion of the shield 5*b* near the photosensitive drum 1, an electric field having the same direction as that of the electric field generated by the corona wire 5*a* is generated relative to the potential of the first toner image on the photosensitive drum 1 and the potential of the non-illumination portion after re-charging. Accordingly, due to such electric fields having the same direction, the toner particles 20 (having negative polarity) on the portion of the photosensitive drum 1 near the shield 5*b* are subjected to a force for urging the toner particles against the photosensitive drum 1, thereby preventing the toner particles 20 from flying toward the shield 5*b*.

In this way, according to the present invention, the toner particles 20 on the photosensitive drum 1 can be prevented from flying toward the shield 5*b,* by the Coulomb force generated by re-charging of the re-charger 5 and the force obtained from the electric field generated by applying the voltage of −850 V to the shield 5*b*.

In the above explanation, since the toner particles on the photosensitive drum 1 are prevented from flying toward the shield 5*b* by generating the electric field (from the shield 5*b*) having the same direction as that of the electric field generated by the corona wire 5*a,* the voltage applied to the shield 5*b* from the external electric power source 21 may be equal to or greater than the negative potential of the toner image on the photosensitive drum 1 after the re-charging.

However, when the long term use of the re-charger 5 is taken into consideration, in addition to the toner contamination of the shield 5*b,* the toner contamination of the corona wire 5*a* also causes a serious problem. To prevent this, it is necessary that the discharging time of the re-charger 5 should be shortened as less as possible, and, it is desirable that only a portion of the photosensitive drum 1 around the first toner image is re-charged.

To this end, in the illustrated embodiment, firstly, at the same time when the first laser (semi-conductor laser 12) is turned ON, the corona-discharging of the re-charger 5 is started, and, after a position of the photosensitive drum upon OFF of the first laser (trail end position of the first latent image) is passed through the re-charger 5, the corona-discharging of the re-charger 5 is stopped. That is to say, by re-charging only the first toner image and the portion of the photosensitive drum near and upstream the first toner image, the re-charging time is shortened.

However, in this re-charging time shortening method, since the bias is not applied to the shield 5*b* during the re-charging of the portion (of the photosensitive drum) upstream the first toner image, the above-mentioned reverse electric field is generated between the photosensitive drum 1 and the shield 5*b*. Consequently, the scattered toner and/or fog toner generated by driving the first developing device 4 is adhered to the shield 5*b* to smudge the latter, which leads in the toner contamination of the corona wire 5*a*.

To avoid this, in the illustrated embodiment, secondly, the voltage continues to be applied to the shield 5*b* of the re-charger 5 from the external electric power source 21 during the driving time (rotation) of the first developing device 4 (i.e., the application of voltage is started prior to the re-charging and is finished after the re-charging). As mentioned above, the voltage applied to the shield is equal to or greater than the negative potential of the toner image on the photosensitive drum 1 after the re-charging.

In order to ascertain the effect of the illustrated embodiment, the tests were carried out. In the tests, after the first red solid toner image was formed on the photosensitive drum 1 and then the photosensitive drum 1 was re-charged by the re-charger 5 with corona-discharging, the first toner image was transferred onto the normal sheet to form the solid red image on the sheet and such image formation was repeated for 10,000 sheets, and toner contamination on the corona wire 5*a* and the shield 5*b* of the re-charger 5 after the image formation was checked. The test results are shown in the following Table 1.

TABLE 1

| voltage applied to wire/shield of re-charger | | wire contamination/ shield contamination 3000 sheets | 5000 sheets | 10000 sheets |
|---|---|---|---|---|
| wire: | during rotation of developing device | ○/○ | Δ/○ | x/○ |
| shield: | during rotation of developing device | | | |
| wire: | from start of first latent image formation to re-charger of first toner image | ○/Δ | ○/x | Δ/x |
| shield: | from start of first latent image formation to re-charger of first toner image | | | |
| wire: | from start of first latent image formation to re-charger of first toner image | ○/○ | ○/○ | ○/○ |
| shield: | during rotation of developing device | | | |

(○: good, Δ: average, x : bad)

As shown in the Table 1, when the voltages were applied to the corona wire 5*a* and the shield 5*b* of the re-charger 5 during the rotation of the first developing device 4, the toner contamination on the shield could be prevented, but the toner contamination on the corona wire was generated after about 5,000 copies were formed. On the other hand, from the start of the formation of the first latent image to the passage of the re-charger 5 for the first toner image, when the voltages were applied to the corona wire 5*a* and the shield 5*b*, the toner contamination on the shield was generated after about 3,000 copies were formed and the toner contamination on the corona wire was also generated after 10,000 copies were formed. This means that, when the toner contamination on the shield is generated, the toner contamination on the corona wire is apt to occur.

To the contrary, as the characteristic of the illustrated embodiment, when the application of voltage to the corona wire 5*a* was effected from the start of the formation of the first latent image to the passage of the re-charger 5 for the first toner image (i.e., only the first toner image and the portion of the photosensitive drum upstream the first toner image were re-charged) and when the voltage was applied to the shield 5*b* during the rotation of the first developing device 4, the toner contamination on both the shield and the corona wire was not generated even after 10,000 copies were formed.

Thus, according to the illustrated embodiment, the scattered toner and fog toner generated by the driving of the first developing device 4 before, during and after the re-charging can be prevented from flying toward and being adhered to the shield 5*b,* thereby preventing the toner contamination of the re-charger.

As mentioned above, in the illustrated embodiment, since the voltage is applied to the shield 5*b* during the re-charging of the re-charger 5, the toner on the photosensitive drum 1 is urged against the photosensitive drum 1 by the electric field generated by the voltage applied to the shield 5*b,* thereby preventing the toner from flying toward and being adhered to the shield 5*b* to suppress the toner contamination. Further, since only the first toner image and the portion of the photosensitive drum near and upstream the first toner image are re-charged, the discharging time of the re-charger can be shortened. As a result, even when the copying operation is repeated, the toner adhered to the shield 5*b* can be prevented from transferring to the corona wire 5*a* of the re-charger 5, thereby preventing the toner contamination on the wire.

In a condition that the voltage of −850 V is applied to the shield 5*b* of the re-charger 5, when 100,000 copies are formed from a single original, it was found that uneven charging due to wire contamination is not generated and the distortion of the first color toner image is not generated in the second color development (which would be generated if the potential of the latent image for the first toner image after the re-charging (surface potential of a portion of the photosensitive drum 1 on which the first toner image was formed) does not become substantially the same as the potential of the non-image portion), and toner adhesion to portions other than the second color latent image is not generated, thereby obtaining a high quality two-color image.

Further, since the toner from the first developing device 4 does not enter into the second developing device 7, the image obtained in the second development does not become obscure.

Second Embodiment

In the first embodiment, by applying the voltage having the same polarity as that of the toner to the shield 5*b* of the re-charger from the external electric power source 21 to generate the electric field force for urging the first toner image against the photosensitive drum 1, the toner on the photosensitive drum can be prevented from flying toward the shield 5*b,* and, by re-charging only the first toner image and the portion of the photosensitive drum near and upstream the first toner image, the discharging time period of the re-charger. Thus, even when the copying operation is repeated, the toner contamination on the wire 5*a* of the re-charger can be prevented.

However, if the frictional charging potential of the toner used in the first developing device 4 is small, the toner contamination is generated at a downstream portion of the shield 5*b* of the re-charger 5 with respect to the rotational direction of the photosensitive drum 1. This is caused by a transit phenomenon in which, when the toner on the photosensitive drum 1 reaches an opening portion of the re-charger 5 after such toner was passed through an upstream portion of the shield 5*b,* such toner is subjected to re-charging corona. That is to say, when the (negative) toner on the photosensitive drum 1 is subjected to the negative re-charging corona, since a repelling force (Coulomb force) acts on the toner layer on the drum, toner adhered to the photosensitive drum 1 with weak adhering force overcome the electric field force for urging the first toner image against the photosensitive drum 1, with the result that such toner is scattered and is flying toward the downstream portion of the shield 5*b* of the re-charger 5, thereby adhering to the latter.

The toner flying within the re-charger 5 is adhered to not only the shield 5*b* but also the corona wire 5*a* of the re-charger 5, thereby causing the uneven charging. To avoid this, similar to the shield 5*b,* it is desirable that an electric field force for urging the first toner image against the photosensitive drum 1 within the opening portion of the re-charger 5 by application of voltage.

Figure 5:
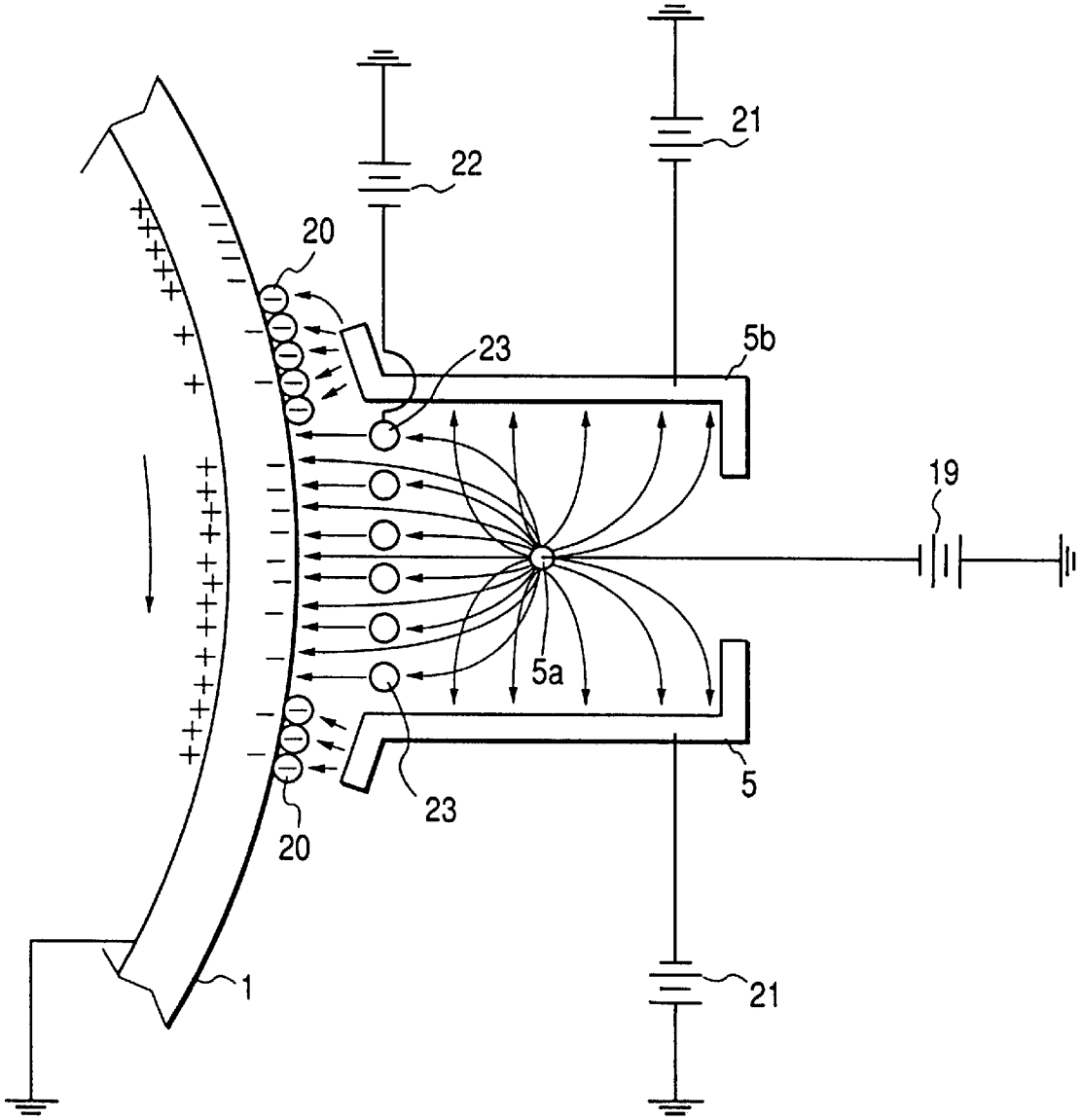
FIG. 5 is an explanatory view showing prevention of toner contamination on a re-charger according to another embodiment of the present invention.

To this end, in a second embodiment of the present invention, as shown in FIG. 5, a re-charger 5 having grids 23 disposed within the opening portion of the re-charger is used. In the illustrated embodiment, each grid 23 is made of SUS and has a diameter of 100 $\mu$m, and the grids 23 extend along an axial direction of the photosensitive drum 1 with a gap of about 1 mm between the grids and the photosensitive drum 1. The grids 23 are spaced apart from each other by 1 mm in the circumferential direction of the photosensitive drum 1. The grids 23 are connected to an external electric power source 22 so that voltage of −850 V (same as that for the shield 5*b*) having the same polarity as that of the toner are applied to the grids for the same time period as that for the shield 5*b*.

With the arrangement as mentioned above, the electric field force for urging the first toner image against the photosensitive drum 1 is also generated within the opening portion of the re-charger 5, and, even immediately after the toner is subjected to the negative re-charging corona, since the sufficient electric field force for urging the toner against the photosensitive drum 1 acts on the toner, the toner is prevented from flying toward the shield 5*b* and the interior of the opening portion of the re-charger 5, thereby preventing the toner flying in the re-charger 5 from adhering to the corona wire 5*a*.

However, if the voltage applied to the shield 5*b* is too great, as a result of tests, it was found that the carrier adhered to the first laser non-illumination portion (non-image portion for the first electrostatic latent image) and reversely charged positive toner (inversion toner) are flying toward the shield 5*b*. A relation between voltage values applied to the shield 5*b* and the grids 23 (same value) and the toner contamination is shown in the following Table *2*.

TABLE 2

| | voltage (V) applied to shield/grids | | | | | | |
|---|---|---|---|---|---|---|---|
| | 0 | −200 | −500 | −700 | −850 | −1000 | −1500 |
| Toner contamination of shield/grids | very bad | bad | normal | good | very good | good to normal | normal |

As shown in the Table 2, when the voltage value applied to the shield 5*b* and the grids 23 of the re-charger 5 is 0 to −500 V, the toner contamination is generated due to the toner (on the photosensitive drum 1) flying toward the shield, and, when the voltage value applied to the shield and the grids is −1000 to −1500 V, the toner contamination on the shield and the grids is generated by the carrier and the reversely charged positive inversion toner on the photosensitive drum 1.

In consideration of the above, in the second embodiment, voltage $V_0$ [V] applied to the shield 5*b* and/or the grids 23 of the re-charger 5 is selected to satisfy the following relations (1) and (2):

$$|(V_0-V_T)/d| \geqq 0.3\ [V/\mu m] \quad (1)$$

$$0.9\ [V/\mu m] \geqq |(V_D-V_0)/d| \quad (2)$$

where, $V_T$ is potential [V] of the first toner image when it is passed through the re-charger, $V_D$ is potential [V] of the first electrostatic latent image non-image portion when it is passed through the re-charger and d is a distance [$\mu$m] between the photosensitive drum and the shield or the grids.

By selecting the voltage $V_0$ applied to the shield 5*b* and/or the grids 23 of the re-charger 5 to satisfy the above relations (1) and (2), the electric field force for urging the toner against the photosensitive drum 1 can be generated to prevent the toner from flying toward the shield and the grids and prevent the carrier and the inversion toner from flying toward and adhering to the shield and the grids.

Also in the second embodiment, as is in the first embodiment, in consideration of the long term use of the re-charger 5, since the serious problem is arisen by the toner contamination on the corona wire 5*a* rather than the contamination on the shield 5*b* and the grids 23, the re-charging time period is shortened to prevent such inconvenience. That is to say, the corona-discharging of the re-charger 5 is started at the same time when the first laser (semi-conductor laser 12) is turned ON and the corona-discharging of the re-charger 5 is finished after the position of the photosensitive drum upon OFF of the first laser (position of the trail end of the first latent image) is passed through the re-charger 5, thereby re-charging only the first toner image and the portion of the photosensitive drum near and upstream the first toner image.

And, the voltage satisfying the above relations (1) and (2) (more specifically, voltage of −850 V) is applied to the shield 5*b* and the grids 23 of the re-charger 5 during the driving (rotation) of the first developing device 4 (i.e., from before the re-charging is started till after the re-charging is finished).

In order to ascertain the effect of the second embodiment, tests were carried out. In the tests, after a first red solid toner image was formed on the photosensitive drum 1 and then the photosensitive drum 1 was re-charged by the re-charger 5 with corona-discharging, the first toner image was transferred onto a normal sheet to form a red solid image as an output image. Such image formation was effected for 50,000 or more sheets, and the toner contamination on the corona wire and the toner contamination on the grids/shield of the re-charger 5 were checked. Test results are shown in the following Table 3.

TABLE 3

| voltage applied to wire, shield and grids of re-charger | | wire contamination/shield contamination | | |
|---|---|---|---|---|
| | | 5000 sheets | 10000 sheets | 50000 sheets |
| wire: | during rotation of developing device | ○/○ | Δ/○ | x/○ |
| shield/grids: | during rotation of developing device | | | |
| wire: | from start of first latent image formation to re-charger of first toner image | ○/Δ | ○/x | Δ/x |
| shield/grids: | from start of first latent image formation to re-charger of first toner image | | | |
| wire: | from start of first latent image formation to re-charger of first toner image | ○/○ | ○/○ | ○/○ |
| shield/grids: | during rotation of developing device | | | |

(○: good, Δ: average, x: bad)

As can be seen from the above Table 3, by using the condition of the second embodiment, the toner contamination on the corona wire can be prevented for a long term (for image formation by 50,000 sheets or more). That is to say, the re-charger 5 having the grids 23 is used and the voltage satisfying the above relations (1) and (2) is applied to the shield 5*b* and the grids 23 of the re-charger 5 during the driving of the first developing device 4 (i.e., from before the re-charging is started till after the re-charging is finished), and, in order to shorten the re-charging time period, the corona-discharging of the re-charger 5 is started at the same time when the first laser is turned ON and the corona-discharging of the re-charger 5 is finished after the position of the photosensitive drum upon OFF of the first laser is passed through the re-charger 5.

In the illustrated embodiment, since the grids 23 are provided in the re-charger 5, even if the wire 5*a* is contaminated to some extent, the re-charging potential of the photosensitive drum 1 can easily be achieved and the re-charging potential of the photosensitive drum 1 can be kept substantially constant due to the potential converging effect of the grids 23. Accordingly, since the potential of the photosensitive drum 1 after the re-charging can be made substantially the same as the voltage applied to the shield and the grids, a range of a condition for suppressing adhesion of the carrier and inversion toner to the re-charger 5 can be widened greatly. Incidentally, when the voltage of −850 V is applied to the shield and the grids of the re-charger 5, the surface potential of the photosensitive drum 1 after the re-charging becomes maximum (−850 V) at portions of the photosensitive drum other than the first latent image and minimum (−800V) at the first toner image portion.

In the illustrated embodiment, when 200,000 copies are formed from a single original, it was found that uneven charging due to the contamination on the corona wire 5*a* of the re-charger 5 is not generated and the distortion of the first color toner image is not generated in the second color development (which would be generated if the surface potential of the portion of the photosensitive drum 1 on which the first toner image was formed after the re-charging does not become substantially the same as the potential of the non-image portion), and toner adhesion to portions other than the second color latent image is not generated, thereby obtaining a high quality two-color image.

Further, since the toner from the first developing device 4 does not enter into the second developing device 7, the image obtained in the second development does not become obscure.

Third Embodiment

In the first and second embodiments, while an example that the voltage is applied to the shield 5*b* and the grids 23 to prevent the scattering toner from adhering to the re-charger 5 in consideration of the scattering toner generated during the driving of the first developing device 4 was explained, if the toner contamination on the shield and the grids due to the scattering toner generated during the second developing device 7 (in addition to the first developing device) is prevented, the toner contamination on the corona wire 5*a* of the re-charger 5 can be prevented for a further long term.

Figure 6:
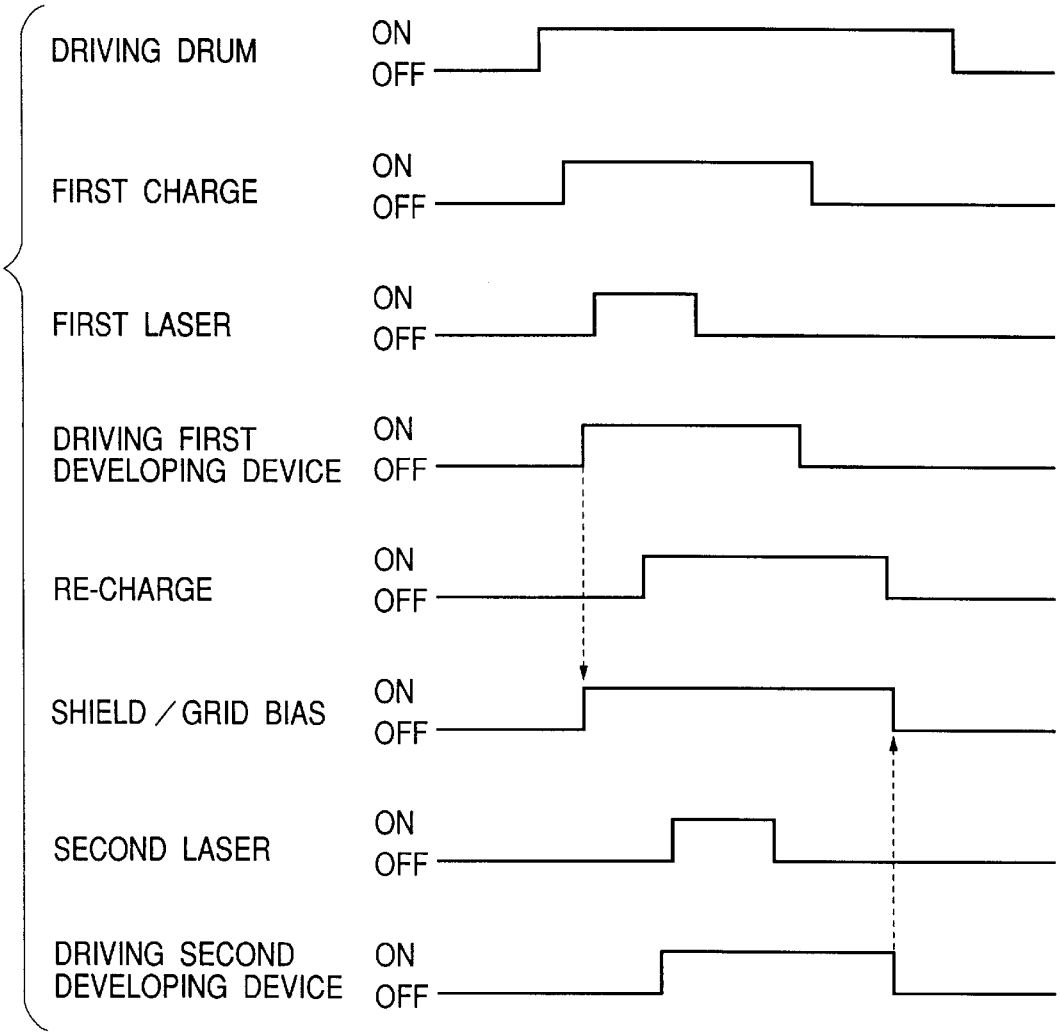
FIG. 6 is a view showing sequences of a re-charger and the like for preventing toner contamination on a re-charger according to a further embodiment of the present invention.

To this end, in a third embodiment of the present invention, the voltage satisfying the above relations (1) and (2) is applied to the shield 5*b* and the grids 23 from when the driving of the first developing device 4 is started till when the driving of the second developing device 7 is finished (from before the re-charging is started till after the re-charging is finished), as shown in FIG. 6. The corona-discharging of the re-charger 5 is started at the same time when the first laser is turned ON and is finished after the position of the photosensitive drum upon OFF of the first laser is passed through the re-charger 5, thereby shortening the re-charging time period.

With the arrangement as mentioned above, the toner can be prevented from flying toward the shield 5*b* and the grids 23 of the re-charger 5 can be prevented and the scattering toner generated by the driving of the first and second developing devices 4, 7 can be prevented from adhering to the corona wire 5*a* of the re-charger 5.

In the illustrated embodiment, when 500,000 copies are formed from a single original, it was found that uneven charging due to the contamination on the corona wire 5*a* of the re-charger 5 is not generated and the distortion of the first color toner image is not generated in the second color development (which would be generated if the surface potential of the portion of the photosensitive drum 1 on which the first toner image was formed after the re-charging does not become substantially the same as the potential of the non-image portion), and toner adhesion to portions other than the second color latent image is not generated, thereby obtaining a high quality two-color image.

Further, since the toner from the first developing device 4 does not enter into the second developing device 7, the image obtained in the second development does not become obscure.

In the first to third embodiments, an example that the voltage is applied to the shield 5*b* and/or the grids 23 of the re-charger 5 during the driving of the first developing device 4 or the second developing device 7 was explained. However, due to poor cleaning of the cleaning device 11, if residual toner remaining on the photosensitive drum 1 is passed through a cleaning member of the cleaning device 11, the passed toner acts like as the scattering toner generated during the driving of the first developing device 4, thereby causing the toner contamination on the shield 5*b* and the grids 23 of the re-charger 5 and further causing the toner contamination on the corona wire 5*a*. To avoid this, it is preferable that the voltage is applied to the shield 5*b* and/or the grids 23 during the rotation of the photosensitive drum 1.

As mentioned above, while the one-pass two-color image forming apparatus having two developing device was explained in connection with the first to third embodiments, the present invention can be applied to multi-color image forming apparatus having three or more developing devices. In this case, by re-charging only the previously formed color toner image and the portion of the photosensitive drum near and upstream of such toner image to reduce the re-charging time period of the re-charger for second and other image formations, and, by applying the voltage to the shield and the grids of the re-charger from before the driving of the first developing device is started till after the driving of a last developing device is finished, the toner contamination on the shield and the grids can be prevented and toner contamination on the corona wire can also be prevented for a long term use.

As mentioned above, while the embodiments of the present invention were explained, the present invention is not limited to such embodiments, but various alterations and modifications can be effected within the scope of the invention.

What is claimed is:

1. An image forming apparatus comprising:

a photosensitive member;

a first developing means for developing an electrostatic image on said photosensitive member;

a charge means for charging said photosensitive member bearing a first developed image formed by said first developing means, wherein said charge means includes a discharge electrode member and a shield member surrounding said discharge electrode member;

an exposure means for image-exposing said photosensitive member charged by said charge means;

a second developing means for developing an electrostatic image formed by exposure of said exposure means; and a voltage apply means for applying voltage having the same polarity as that of the first developed image to said shield member, wherein said voltage apply means applies voltage more than potential of the first developed image.

2. An image forming apparatus comprising:

a photosensitive member;

a first developing means for developing an electrostatic image on said photosensitive member;

a charge means for charging said photosensitive member bearing a first developed image formed by said first developing means, wherein said charge means includes a discharge electrode member and a shield member surrounding said discharge electrode member;

an exposure means for image-exposing said photosensitive member charged by said charge means;

a second developing means for developing an electrostatic image formed by exposure of said exposure means; and a voltage apply means for applying voltage having the same polarity as that of the first developed image to said shield member, wherein said voltage apply means applies voltage from the time when the driving of said first developing means is started until the driving of said second developing means is finished.

3. An image forming apparatus comprising:

a photosensitive member;

a first developing means for developing an electrostatic image on said photosensitive member;

a charge means for charging said photosensitive member bearing a first developed image formed by said first developing means, wherein said charge means includes a discharge electrode member and a shield member surrounding said discharge electrode member;

an exposure means for image-exposing said photosensitive member charged by said charge means;

a second developing means for developing an electrostatic image formed by exposure of said exposure means; and a voltage apply means for applying voltage having the same polarity as that of the first developed image to said shield member, wherein a voltage applying time period of said voltage apply means is longer than a discharging time period of said discharge electrode member.

4. An image forming apparatus comprising:

a photosensitive member;

a first developing means for developing an electrostatic image on said photosensitive member;

a charge means for charging said photosensitive member bearing a first developed image formed by said first developing means, wherein said charge means includes a discharge electrode member and a shield member surrounding said discharge electrode member;

an exposure means for image-exposing said photosensitive member charged by said charge means;

a second developing means for developing an electrostatic image formed by exposure of said exposure means; and a voltage apply means for applying voltage having the same polarity as that of the first developed image to said shield member, wherein the charging of said charge means is effected only substantially at an image area.

5. An image forming apparatus comprising:

a photosensitive member;

a first developing means for developing an electrostatic image on said photosensitive member;

a charge means for charging said photosensitive member bearing a first developed image formed by said first developing means, wherein said charge means includes a discharge electrode member and a shield member surrounding said discharge electrode member;

an exposure means for image-exposing said photosensitive member charged by said charge means;

a second developing means for developing an electrostatic image formed by exposure of said exposure means; and a voltage apply means for applying voltage having the same polarity as that of the first developed image to said shield member, wherein the voltage ($V_0$) applied by said charge means is selected to satisfy the following relations, where $V_T$ is potential (V) of the first developed image when it is passed through said charge means, $V_D$ is potential (V) of a non-image portion of first electrostatic image, and d is a distance ($\mu$m) between said photosensitive member and said shield member:

$$|V_0-V_T)/d| \geqq 0.3\ (V/\mu m)$$

and $$0.9\ (V/\mu m) \geqq |V_D-V_0)/d|.$$

* * * * *

UNITED STATES PATENT AND TRADEMARK OFFICE

CERTIFICATE OF CORRECTION

PATENT NO. : 5,911,093

DATED : June 8, 1999

INVENTOR : Keishi Ohsawa

It is certified that error appears in the above-identified patent and that said Letters Patent is hereby corrected as shown below:

COLUMN 1

Line 10, "image" should read --image.--;
Line 29, "development" should read --development.--; and
Line 65, "arises" should read --raises--.

COLUMN 2

Line 11, "form" should read --forming--.

COLUMN 3

Line 54, "formation" should read --formation.--.

COLUMN 4

Line 8, "image is developed" should be deleted;
Line 9 should be deleted; and
Line 61, "against" should be deleted.

COLUMN 5

Line 58, "less" should read --little--.

COLUMN 6

Line 2, "upstream" should read --upstream of--.

UNITED STATES PATENT AND TRADEMARK OFFICE

CERTIFICATE OF CORRECTION

PATENT NO. : 5,911,093

DATED : June 8, 1999

INVENTOR : Keishi Ohsawa

It is certified that error appears in the above-identified patent and that said Letters Patent is hereby corrected as shown below:

COLUMN 8

Line 21, "overcome" should read --overcomes--.

COLUMN 14

Line 41, "$|V_O - V_T)$" should read --$|(V_O - V_T)$--; and
Line 46, "$|V_D - V_O)/d|$" should read --"$|(V_D - V_O)/d|$--.

Signed and Sealed this

Fourth Day of April, 2000

*Attest:*

Q. TODD DICKINSON

*Attesting Officer*

*Director of Patents and Trademarks*